US007997996B2

(12) United States Patent
Lagano

(10) Patent No.: US 7,997,996 B2
(45) Date of Patent: Aug. 16, 2011

(54) SWING TRAINING DEVICE AND SYSTEM

(75) Inventor: Joseph Lagano, Los Angeles, CA (US)

(73) Assignee: Joseph Lagano, Los Angeles, CA (US)

( * ) Notice: Subject to any disclaimer, the term of this patent is extended or adjusted under 35 U.S.C. 154(b) by 0 days.

(21) Appl. No.: 12/813,063

(22) Filed: Jun. 10, 2010

(65) Prior Publication Data

US 2010/0317452 A1 Dec. 16, 2010

Related U.S. Application Data

(60) Provisional application No. 61/268,257, filed on Jun. 10, 2009.

(51) Int. Cl.
*A63B 69/36* (2006.01)

(52) U.S. Cl. ..... 473/270; 473/269; 473/272; 473/452

(58) Field of Classification Search ..... 473/218, 473/266, 269, 270, 271, 272, 273, 278, 452
See application file for complete search history.

(56) References Cited

U.S. PATENT DOCUMENTS

| | | | | |
|---|---|---|---|---|
| 4,023,810 | A * | 5/1977 | Lorang | 473/218 |
| 4,037,847 | A * | 7/1977 | Lorang | 473/269 |
| 5,118,112 | A * | 6/1992 | Bregman et al. | 473/269 |
| 5,150,902 | A * | 9/1992 | Heisler | 473/269 |
| 5,419,562 | A * | 5/1995 | Cromarty | 473/269 |
| 6,039,658 | A * | 3/2000 | Cecchin | 473/269 |
| 6,402,635 | B1 * | 6/2002 | Nesbit et al. | 473/269 |
| 6,723,004 | B1 * | 4/2004 | Florian | 473/270 |
| 2006/0234816 | A1 * | 10/2006 | Reason-Kerkhoff | 473/452 |
| 2007/0082760 | A1 * | 4/2007 | Reason-Kerkhoff | 473/451 |

* cited by examiner

*Primary Examiner* — Nini Legesse
(74) *Attorney, Agent, or Firm* — Troutman Sanders LLP

(57) ABSTRACT

Described is a swing training device comprising a first foot plate, a second of foot plate, a connector connecting the first foot plate to the second foot plate, a first foot pad pivotably mounted on the first foot plate, and a second foot pad pivotably mounted on the second foot plate. The swing training device may be useful for teaching balance and developing core muscles used while swinging a sporting device.

16 Claims, 2 Drawing Sheets

SWING TRAINING DEVICE AND SYSTEM

CROSS-REFERENCE TO RELATED APPLICATIONS

This application claims the benefit of U.S. Provisional Application No. 61/268,257 filed on Jun. 10, 2009.

BACKGROUND OF THE INVENTION

Various sports require the use of core muscles (e.g., the lower and upper back, abdomen and hips) to swing an apparatus during play. For example, in golf and hockey, a player swings an apparatus in a pendulum-type motion. In baseball, softball and tennis, a player swings an apparatus across his body. Each swing motion utilizes the core muscles to generate speed and power to drive an object at a desired velocity and toward a desired direction.

Balance is also a critical factor in developing and refining the swing, because shifting weight from front-to-back and/or pivoting on the front and/or back foot significantly affects the velocity and direction of the object struck.

Training the core muscles through exercises may not provide corresponding results in developing the swing, because such exercises may not incorporate the balance training that is required to achieve the desired result. Thus, there is a need for a means to train an individual on the proper swing technique, which incorporates core muscle development and balance training.

SUMMARY OF THE INVENTION

The present invention describes a swing training device and system. In an exemplary embodiment, a swing training device comprises a first foot plate, a second of foot plate, a connector connecting the first foot plate to the second foot plate, a first foot pad pivotably mounted on the first foot plate, and a second foot pad pivotably mounted on the second foot plate.

In an exemplary embodiment, a system for swing training comprises a swing training device that comprises a first foot plate, a second of foot plate, a connector connecting the first foot plate to the second foot plate, a first foot pad pivotably mounted on the first foot plate, and a second foot pad pivotably mounted on the second foot plate, and a computing device communicatively coupled to the swing training device. The computing device may receive signals indicative of movement of at least one component of the swing training device.

BRIEF DESCRIPTION OF THE DRAWINGS

A more complete understanding of the apparatus and system of the present invention may be obtained by reference to the following Detailed Description when taken in conjunction with the accompanying Drawings wherein.

DETAILED DESCRIPTION OF THE INVENTION

Figure 1:
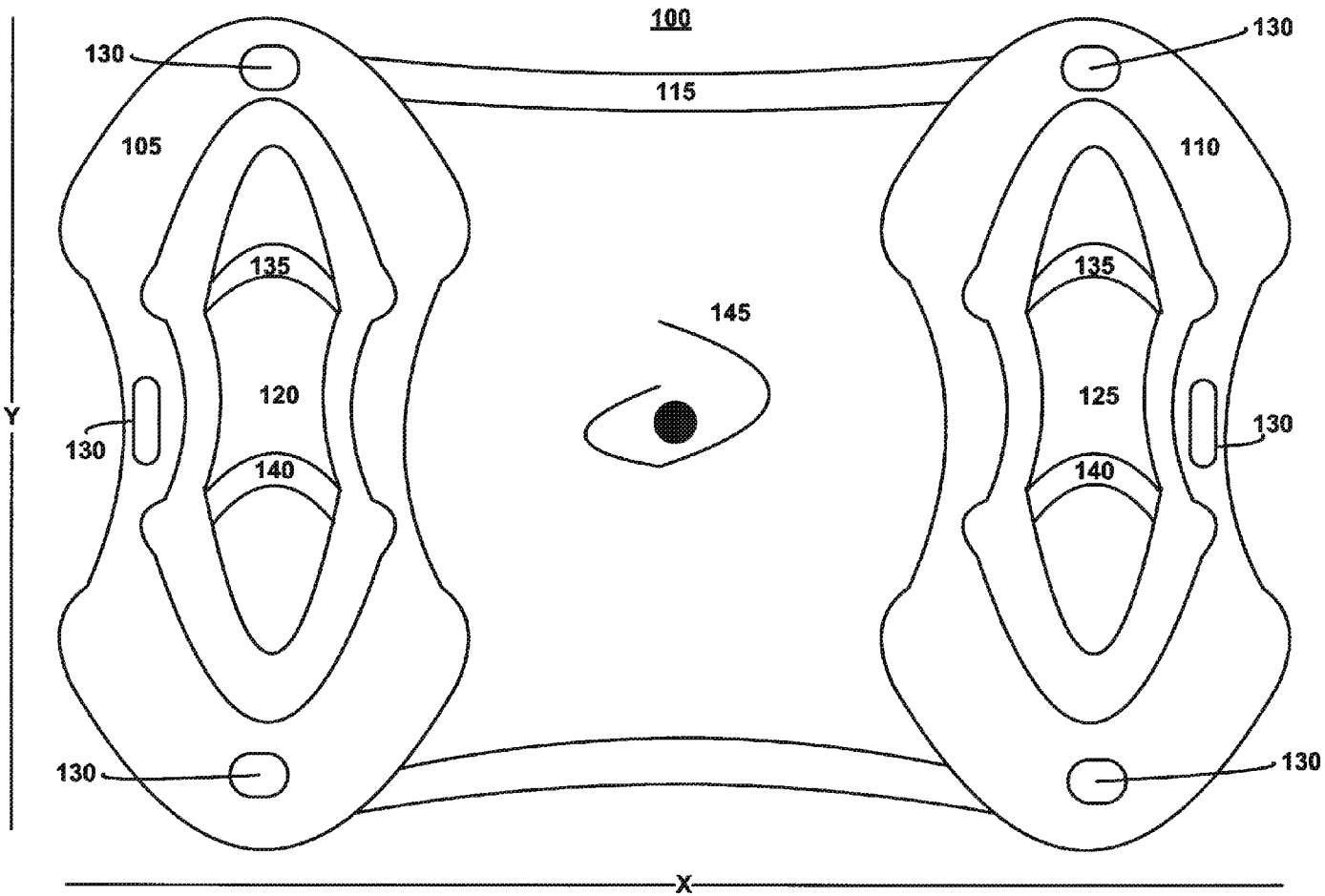
FIG. 1 is a top-view of an exemplary embodiment of a swing training device according to the present invention.

The present invention may be further understood with reference to the following description and the appended drawings, wherein like elements are referred to with the same reference numerals. The present invention describes a device and system for swing training for one or more activity types including, but not limited to, golf, hockey, baseball, softball and tennis. Those of skill in the art will understand that the same device may be utilized for all (or a subset) of activity types, or the swing training device may be specifically designed for each activity type.

FIG. 1 shows an exemplary embodiment of a swing training device 100 according to the present invention. In this embodiment, a first foot plate 105 is connected to a second foot plate 110 via a connector 115. On a top surface of the first foot plate is a first foot pad 120, and on a top surface of the second foot plate is a second foot pad 125. The first and second foot pads 120, 125 may be sized and shaped to receive a user's feet (with or without shoes or sneakers on). For example, each foot plate may have a length y, which may be selected based on the type of user (child or adult, or by height or weight), the activity type and/or the skill level of the user. In one exemplary embodiment, the length y may be about 17-20 inches. The device 100 may have a width x which indicates a distance between outer edges of the foot plates 105, 110 with the connector 115 therebetween. In one exemplary embodiment, the width x may be about 25-30 inches.

Each foot pad may have a top surface which is formed from (or coated with) a material which prevents slippage of the user's foot during use of the device 100.

Each of the first and second foot pads 120, 125 may be pivotably connected to the first and second foot plates 105, 110, respectively. A pivoting arrangement 150, 155 (e.g., ball bearings, rotatable disc, etc.) may be formed at a midpoint of each of the first and second foot pads 120, 125 or offset from the midpoint. The pivoting arrangement 150, 155 may further include at least one stopping member 160, 165 restricting rotation of the foot pad relative to the foot plate to a predefined angular range. The predefined angular range may be the same or different for the first and second foot pads 120, 125. In one exemplary embodiment, each of the first and second foot pads 120, 125 may be slidably coupled to the pivoting arrangement, such that a user may move each foot pad relative to the pivoting arrangement and change a location of an axis of rotation of the foot pads relative to the foot plates. Each foot pad may then be secured to the pivoting arrangements to ensure that the foot pads do not slide relative to the foot plates during use. This may be useful when a user desires to train with, for example, an "open" or "closed" stance in baseball.

The connector 115 may detachably engage the first and second foot plates 105, 110. For example, different size foot plates may be used for children and adults, for different activity types, and/or for different skill levels.

At least one handle 130 may be formed in or attached to the device 100. For example, as shown in the exemplary embodiment of FIG. 1, three handles 130 may be formed (e.g., as cut-outs) in the first foot plate 105 and three handles 130 may be formed in the second foot plate 110. The handles 130 may allow the user to carry the entire device 100 or the foot plates 105, 110 separately (e.g., when detached from the connector 115). In another exemplary embodiment, the handles 130 may be straps or grips attached to the foot plates 105, 110. Those of skill in the art will understand that the location and number of the handles 130 may vary.

At least one adjustable strap may be fixed to each of the first and second foot pads 120, 125. In the exemplary embodiment shown in FIG. 1, a pair of adjustable straps 135, 140 may be fixed to each of the first and second foot pads 120, 125. The adjustable straps 135, 140 may be loosened to allow the user to slide his foot onto the foot pad and tightened when the foot is properly in place. The foot pads may include indicia (e.g., a foot outline) indicating the proper placement of a foot on the foot pad. The adjustable straps 135, 140 may be tightened and secured by Velcro, buckles, ties, etc.

In an exemplary embodiment, a logo 145 may be printed on the device 100. In the exemplary embodiment shown in FIG. 1, the logo 145 may be printed on a surface of the connector 115.

Figure 2:
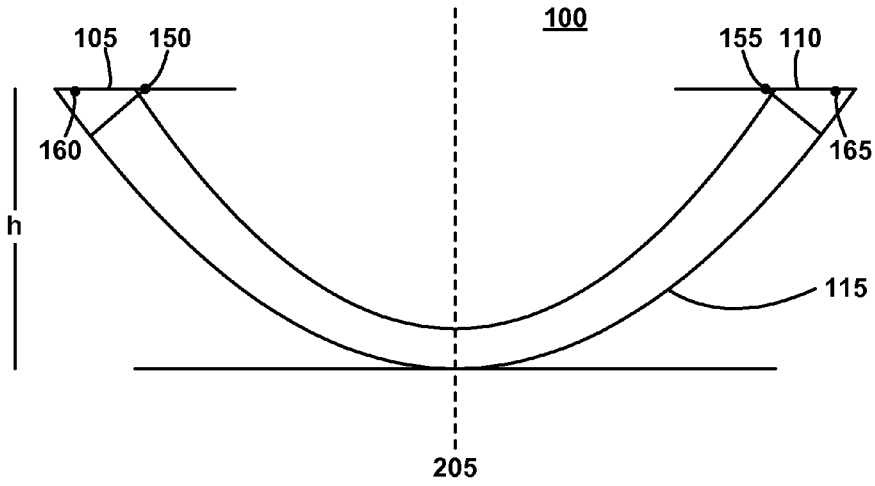
FIG. 2 is a side-view of an exemplary embodiment of a swing training device according to the present invention.

FIG. 2 shows a side view of an exemplary embodiment of the device 100. The connector 115, as shown in this exemplary embodiment, is symmetrically concave and U-shaped. A height h indicates a distance from a midpoint 205 of the connector 105 to a plane of the foot plates 105, 110. The height h may be selected based on, for example, the type of user (child or adult, or by height or weight), the activity type and/or the skill level of the user. For example, in one exemplary embodiment, the height h is about 5 inches if the user is a beginner and about 8 inches if the user is an advanced user. Those of skill in the art will understand that the shape of the connector 115 may vary and that it may be asymmetrical. For example, in one exemplary embodiment, a point at which the connector 115 contacts a surface (e.g., the ground or playing surface) may be shifted closer to either of the first or second foot plates 105, 110. In this exemplary embodiment, maintaining balance on the device 100 may require the user to shift his weight toward the opposite foot plate. In another exemplary embodiment, the connector 115 may be conical.

In use, a user may place his feet in the foot pads 120, 125 and secure his feet thereto using the adjustable straps 135, 140. The user may shift his weight until neither of the foot plates 105, 110 contacts the ground, and the user is required to maintain the distribution of his weight on the device 100 to keep the foot plates 105, 110 from contacting the ground. The user may then practice swinging a sporting apparatus (e.g., golf club, hockey stick, baseball/softball bat, tennis racquet, etc.) while standing on the device 100. The pivoting arrangement on each of the foot pads 120, 125 allows the user to pivot relative to the foot plates 105, 110, which teaches balance and strengthens core muscles.

Figure 3:
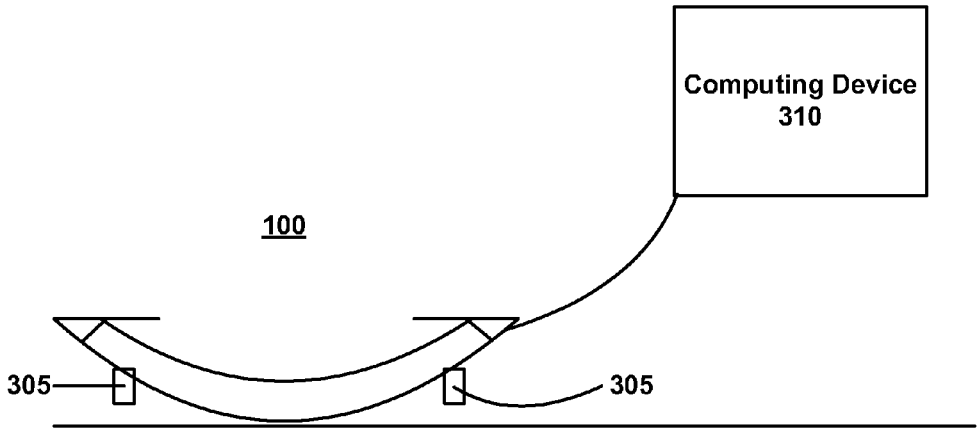
FIG. 3 is an exemplary embodiment of a system for swing training according to the present invention.

FIG. 3 shows an exemplary embodiment of a system 300 according to the present invention. The system 300 may comprise the device 100 and a computing device 305 communicatively coupled thereto. The computing device 305 may receive signals from the device 100 which indicate movement of one or more components of the device 100. For example, sensors 305 may be placed on the connector 105 and send signals to the computing device indicative of a tilt angle of the connector 105. Sensors may also be placed on the foot pads 120, 125 to generate signals indicative of rotation thereof. The computing device 105 may receive the signals from a wired or wireless connection with the device 100. Those of skill in the art will understand that the device 100 may include or be coupled to the appropriate hardware for transmitting (and, optionally, receiving) data signals.

The computing device 305 may utilize the signals from the device 100 to provide feedback data to the user regarding his swing. For example, the feedback data may include information regarding the user's balance, projected velocity of object struck, projected direction of object struck, a speed of the user's swing, a force of the user's swing, etc. The feedback data may also include one or more instructions for correcting or enhancing the user's swing. For example, the computing device 305 may include a display device which displays an image of the user's swing and displays one or more corrective actions (e.g., weight distribution, swing speed, etc.) which the user should take to correct or enhance his swing. The instructions and/or corrective actions may be generated by comparing the feedback data to reference data indicative of desired swing characteristics or a range thereof. The desired swing characteristics may be input by the user or downloaded from a remote location, device and/or medium.

Those of skill in the art will understand that various modifications may be made to, for example, the dimensions of the device 100. Additionally, the device 100 and/or any of its components may be made from the same or different materials including, but not limited to, plastic, wood, and rubber.

The previous description is of a preferred embodiment for implementing the invention, and the scope of the invention should not necessarily be limited by this description. The scope of the present invention is instead defined by the following claims.

What is claimed is:

1. A swing training device, comprising:
- a first foot plate;
- a second of foot plate;
- a connector connecting the first foot plate to the second foot plate, wherein the connector is concave;
- a first foot pad pivotably mounted on the first foot plate; and
- a second foot pad pivotably mounted on the second foot plate.

2. The swing training device according to claim 1, further comprising:
- at least one handle attached to at least one of the first and second foot plates.

3. The swing training device according to claim 1, further comprising:
- at least one adjustable strap fixed to each of the first and second foot pads.

4. The swing training device according to claim 1, wherein the connector is detachably connected to the first and second foot plates.

5. The swing training device according to claim 1, wherein a midpoint of the connector is about 5 to 8 inches lower than a plane of the first and second foot plates.

6. The swing training device according to claim 1, wherein a distance from a first outer edge of the first foot plate to a second outer edge of the second foot plate is about 25 to 30 inches.

7. The swing training device according to claim 1, wherein a distance from a top edge of each of the first and second foot plates to a bottom edge of each of the first and second foot plates is about 17 to 20 inches.

8. The swing training device according to claim 1, further comprising:
- a logo imprinted on the connector.

9. The swing training device according to claim 1, further comprising:
- at least one stopping member restricting rotation of at least one of the first and second foot pads to a predefined angular range.

10. A system for swing training, comprising:
- a swing training device, the swing training device comprising:
  - a first foot plate;
  - a second of foot plate;
  - a connector connecting the first foot plate to the second foot plate, wherein the connector is concave;
  - a first foot pad pivotably mounted on the first foot plate; and
  - a second foot pad pivotably mounted on the second foot plate; and
- a computing device communicatively coupled to the swing training device, wherein the computing device receives signals indicative of movement of at least one component of the swing training device.

11. The system according to claim 10, wherein the computing device receives the signals via at least one of a wired and wireless data transmission.

12. The system according to claim 10, further comprising: a display device displaying a graphical representation of the signals.

13. The system according to claim 10, wherein the computing device provides feedback data based a comparison of the signals to reference data.

14. The system according to claim 13, wherein the reference data is indicative of a predefined range of movement of the at least one component of the swing training device.

15. The system according to claim 14, wherein the reference data is selected based on activity type.

16. The system according to claim 15, wherein the activity type is at least one of golf, hockey, baseball, softball and tennis.

* * * * *